US006682350B2

(12) United States Patent
Kehl et al.

(10) Patent No.: US 6,682,350 B2
(45) Date of Patent: Jan. 27, 2004

(54) LASER PISTOL AND METHOD OR SYSTEM FOR RETROFITTING SHARPSHOOTING PISTOLS

(76) Inventors: Hermann Kehl, Schafgarbenweb 24, D-22549, Hamburg (DE); Alfred De Vries, Augustinushof 86, NL-1216 LG, Hilversum (NL)

( * ) Notice: Subject to any disclaimer, the term of this patent is extended or adjusted under 35 U.S.C. 154(b) by 0 days.

(21) Appl. No.: 10/160,431

(22) Filed: May 31, 2002

(65) Prior Publication Data

US 2002/0194765 A1 Dec. 26, 2002

(30) Foreign Application Priority Data

Jun. 2, 2001 (EP) ..... 01113500

(51) Int. Cl.[7] ..... F41A 33/06; F41A 33/02
(52) U.S. Cl. ..... 434/18; 42/114
(58) Field of Search ..... 42/114; 273/310; 362/111; 434/11–22

(56) References Cited

U.S. PATENT DOCUMENTS

| | | | | | |
|---|---|---|---|---|---|
| 3,898,747 | A | * | 8/1975 | Marshall | 434/22 |
| 4,195,422 | A | | 4/1980 | Budmiger | 35/25 |
| 4,352,665 | A | * | 10/1982 | Kimble et al. | 434/22 |
| 4,380,437 | A | * | 4/1983 | Yarborough, Jr. | 434/18 |
| 4,480,999 | A | * | 11/1984 | Witherell et al. | 434/18 |
| 4,830,617 | A | * | 5/1989 | Hancox et al. | 434/21 |
| 5,119,576 | A | * | 6/1992 | Erning | 42/117 |
| 5,842,300 | A | | 12/1998 | Cheshelski et al. | 42/103 |
| 5,947,738 | A | * | 9/1999 | Muehle et al. | 434/16 |
| 6,146,141 | A | * | 11/2000 | Schumann | 434/11 |

FOREIGN PATENT DOCUMENTS

| | | |
|---|---|---|
| DE | 27 567 210 A1 | 6/1978 |
| WO | WO 98/14745 | 4/1998 |

OTHER PUBLICATIONS

Abstract (in English)of French Patent Application FR 2 685 072 A1 (Jun. 18, 1993).

Abstract (in English) of French Patent Application FR 2 768 220 A1 (Mar. 12, 1999).

* cited by examiner

*Primary Examiner*—Peter M. Poon
*Assistant Examiner*—Troy Chambers
(74) *Attorney, Agent, or Firm*—Roberts & Mercanti, LLP

(57) ABSTRACT

A laser pistol and a method or system for retrofitting sharpshooting pistols whose recoil mechanism is complicated in design and has an unrealistic trigger resistance. A conversion of known sharpshooting pistols into simulation-type laser pistols, whose mechanism has a realistic trigger resistance and a corresponding recoil, and their simple reconversion is provided. This is achieved by providing that the compressed-gas magazine (16) is adapted in its dimensions to the magazine of the particular model of a previously known piston that is to be retrofitted, and the connection valve (14) is connected to a magazine connection piece (10) which has a through bore (34) having an opening pin (13) for the connection valve (14) and a connection (12) with the compressed-gas magazine (16) and a hose coupling (11) to an expansion chamber (7) in the slide (29) above the barrel block (8); and that the striking pin (35) and its location and actuation in the model to be retrofitted are maintained; and that the piston (6) in the expansion chamber (7) is disposed with a bore extending in the longitudinal axis and with a firing pin piece (5) movable in the bore back and forth, is disposed upstream of the tappet (4) of the valve (2), and between the firing pin piece (5) and the inner wall of the piston a slight slip or play is provided for ventilating the expansion chamber (7); and that the spring rod (21) and a return spring (36) are adapted to the existing pressure conditions, in order to press the piston (6) and the firing pin piece (5) back via the slide (29).

10 Claims, 5 Drawing Sheets

Using a Glock® 17/17L/22 as an example:
Compressed-gas-operated Recoil Replacement System with Laser Module Using a Glock® 17/17L/22 as an example:
Compressed-gas-operated Recoil Replacement System with Laser Module Using a Glock® 17/17L/22 as an example:
Compressed-gas-operated Recoil Replacement System with Laser Module → Slide motion by spring and spring rod
→ Slip tolerance for ventilation and ventilation direction Fig. 4
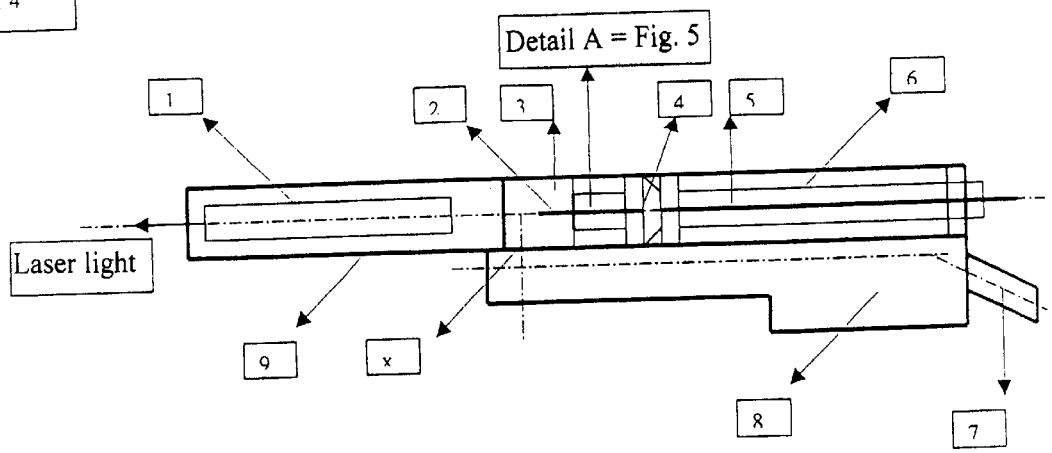
Fig. 3 Magazine adapter
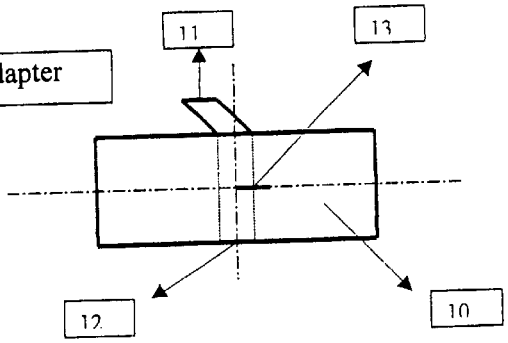

Detail A
20
2
19
3
22
6
5
7
4
2
x

LASER PISTOL AND METHOD OR SYSTEM FOR RETROFITTING SHARPSHOOTING PISTOLS

BACKGROUND OF THE INVENTION

1. Field of the Invention

The invention relates to a laser pistol for simulating pistol shots and to a method or system for retrofitting sharpshooting pistols.

2. Description of the Related Art

One such laser pistol is known for instance from International Patent Disclosure WO 98/14745. In it, a recoil system with a built-in laser for sharpshooting simulation is described. For tripping the recoil system, a specially manufactured mechanism is employed. However, this mechanism allows only a trigger resistance that does not meet the actual conditions of the various weapon types and has therefore been found inadequate in practice. Moreover, the previously known laser pistol requires either completely new construction or conversion of known pistols, which is extremely complicated and therefore expensive in terms of construction, and its economical reconversion is impossible.

It is therefore the object of the present invention to furnish both simple conversion of known sharpshooting pistols into simulation-type laser pistols, whose mechanism has a realistic trigger resistance and a corresponding recoil, and their simple reconversion.

This object is attained by the laser pistol as defined generically at the outset, which is characterized in that the compressed-gas magazine is adapted in its dimensions to the magazine of the particular model of a previously known piston that is to be retrofitted, and the connection valve is connected to a magazine connection piece which has a through bore having an opening pin for the connection valve and a connection with the compressed-gas magazine and a hose coupling to an expansion chamber in the slide above the barrel block; and that the striking pin and its location and actuation in the model to be retrofitted are maintained; and that the piston in the expansion chamber is disposed with a bore extending in the longitudinal axis and with a firing pin piece movable in the bore back and forth, is disposed upstream of the tappet of the valve, and between the firing pin piece and the inner wall of the piston a slight slip or play is provided for ventilating the expansion chamber; and that the spring rod and a return spring are adapted to the existing pressure conditions, in order to press the piston and the firing pin piece back via the slide.

In the laser pistol of the invention, the mechanism of most of the pistols available on the market can be retained, so that the trigger weight or pressure point of the original weapon is also preserved. In other words, the invention enables a relatively simple retrofitting or conversion of previously known sharpshooting pistols into pistols with a simulated recoil and laser tripping, where the conversion requires merely that certain components be exchanged, as described in claim 10. On the basis of this, it should be clear that the laser pistol of the invention can be restored to its original condition without difficulty.

Further advantages and characteristics will become apparent from the dependent claims, which together with the main claim can optionally be of inventive significance. However, it is especially advantageous that with the invention, the tripping of the recoil event is accomplished with the original striking pin, thus assuring a precise agreement in terms of the chronological succession of the individual components, such as the trigger, laser and recoil. It is also assured that with the system or laser pistol of the invention, there is no risk of injury, since it cannot shoot live ammunition. Moreover, it is advantageously notable that a valve system that is sturdy and is not vulnerable to dirt can be employed, which allows a variable operating pressure in the range from about 25 to 40 bar with various compressed gases. Advantageously, the laser is built into the barrel or the spring rod and is activated in noncontacting fashion with an acceleration switch. It is also advantageous that the original dimensions of the pistol are preserved, so that a magazine change can be done as in the original pistol.

A preferred exemplary embodiment is described below in terms of the drawing, for the sake of better comprehension of the invention. This exemplary embodiment shows a retrofitted Glock® sharpshooting pistol 17/17L/22, but the invention is not limited to this. It should be clear that other previously known sharpshooting pistols can be retrofitted in precisely the same way.

SUMMARY OF THE INVENTION

The invention provides a laser pistol for simulating pistol shots by retrofitting a pistol, having:

a pistol grip (30);

a barrel (9) mounted on the pistol grip (30);

a slide (29), which is supported by the pistol grip (30) and is movable along the barrel (9);

a trigger (31) with a trigger guard (32), which are attached to the pistol grip (30) and the barrel (9);

means for cocking the striking pin (35) and actuating the pistol; and a compressed-gas magazine (16), which is insertable from below into the pistol grip (30) and on its upper end has a connection valve (14) and on its lower end is provided with a connection bore (18), in which a check valve (17) is seated;

wherein a laser module (1) is provided, which upon actuation of the trigger (31) emits a target-spot laser beam;

wherein an electronic control is disposed in the pistol and is coupled with the laser (1) and the trigger (31);

wherein a battery is accommodated in the pistol grip (30) or barrel (9) and is connected to the electronic control;

wherein a compressed-gas cylinder (20) is disposed in the slide (29) and upon imposition of compressed gas moves a piston (6) rearward;

and wherein a switchover valve (2) with a valve tappet (4) is actuatable by the trigger (31);

wherein the compressed-gas cylinder (20) communicates fluidically with a compressed-gas chamber (3) via the switchover valve (2), wherein the compressed-gas magazine (16) is adapted in its dimensions to the magazine of the particular model of a pistol that is to be retrofitted, and the connection valve (14) is connected to a magazine connection piece (10) which has a through bore (34) having an opening pin (13) for the connection valve (14) and a connection (12) with the compressed-gas magazine (16) and a hose coupling (11) to an expansion chamber (7) in the slide (29) above the barrel block (8);

and that the striking pin (35) and its location and actuation in the model to be retrofitted are maintained; and that the piston (6) in the expansion chamber (7) is disposed with a bore extending in the longitudinal axis and with a firing pin piece (5) movable in the bore back and forth, is disposed upstream of the tappet (4) of the valve (2), and between the firing pin piece (5) and the inner wall of the piston a slight slip or play is provided for ventilating the expansion chamber (7); and that the spring rod (21) and a return spring (36) are adapted to the existing pressure conditions, in order to press the piston (6) and the firing pin piece (5) back via the slide (29).

The invention also provides a method or system for retrofitting a sharpshooting pistol comprising a barrel, magazine, spring rod and/or spring, into a laser pistol for simulating pistol shots, comprising a. the removal of the barrel, magazine, spring rod and/or spring;

b. the insertion of the following new components:

barrel (9) with compressed-gas cylinder (20) and compressed-gas chamber (3); switchover valve (2) and tappet (4); and piston (6) with firing pin piece (5); as well as compressed-gas magazine (16), magazine connection piece (10), hose coupling (11), spring rod (21), and/or spring (36).

BRIEF DESCRIPTION OF THE DRAWINGS

Shown are:

FIG. 3, a schematic cross-sectional view of the magazine connection piece to be inserted according to the invention;

FIG. 4, a cross-sectional view of the retrofitted barrel with bearing block that is to be inserted according to the invention.

DETAILED DESCRIPTION OF THE INVENTION

Figure 1A:
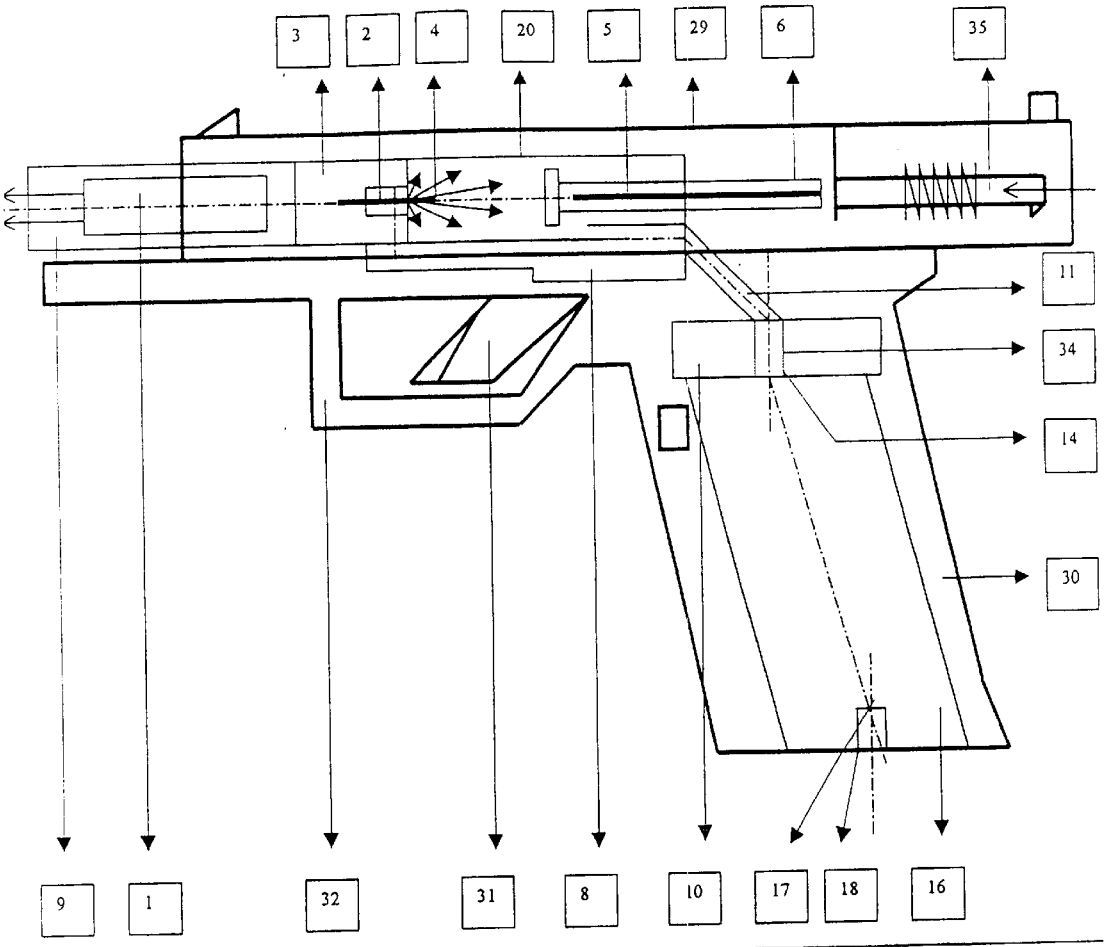
FIG. 1A, a schematic cross-sectional view through a laser pistol of the invention, showing a retrofitted Glock® sharpshooting pistol before the striking pin is tripped.
Figure 1B:
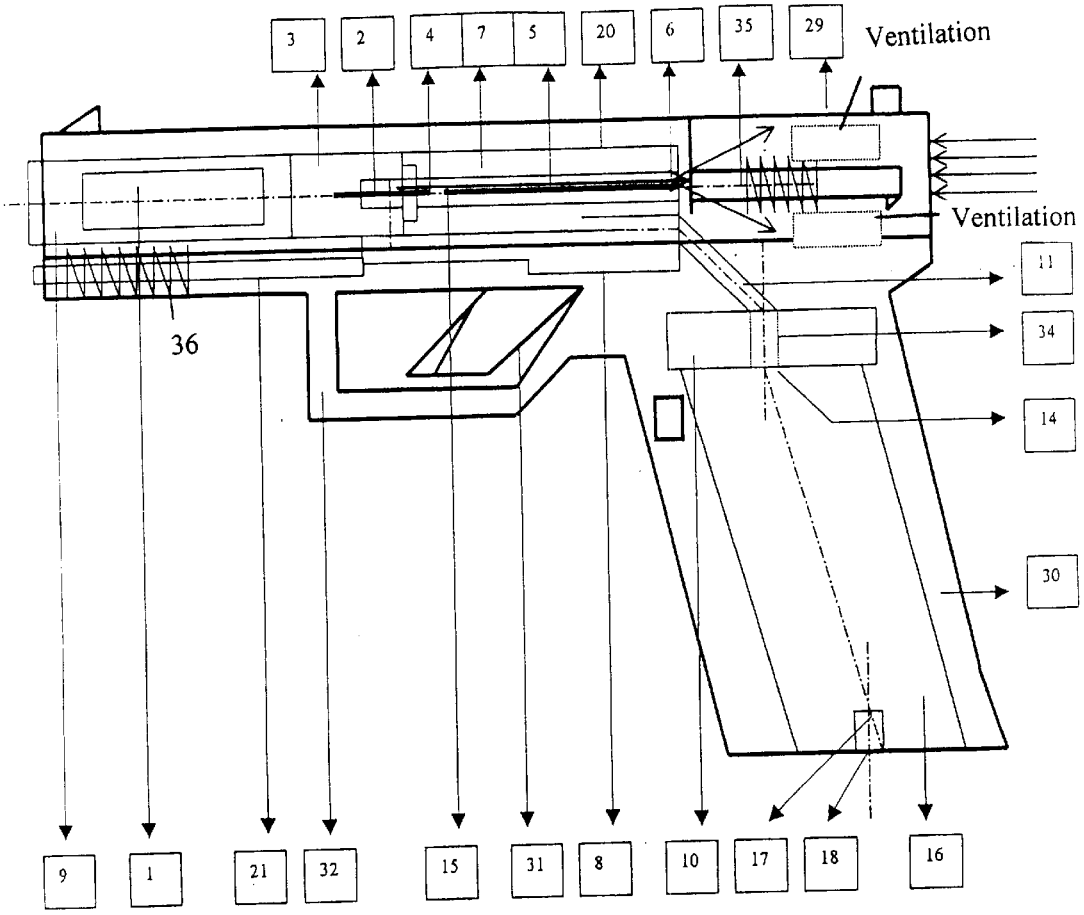
FIG. 1B, a schematic cross-sectional view of the laser pistol of the invention, shown in FIG. 1*a*, after tripping of the striking pin.

In FIGS. 1*a* and 1*b*, the laser pistol of the invention is shown schematically, with a pistol grip 30 that in a manner known per se supports a barrel 9 with a barrel block 8, which are covered by a slide 29. A trigger 31 is pivotably supported in the body of the laser pistol and is protected by a trigger guard 32.

Figure 2:
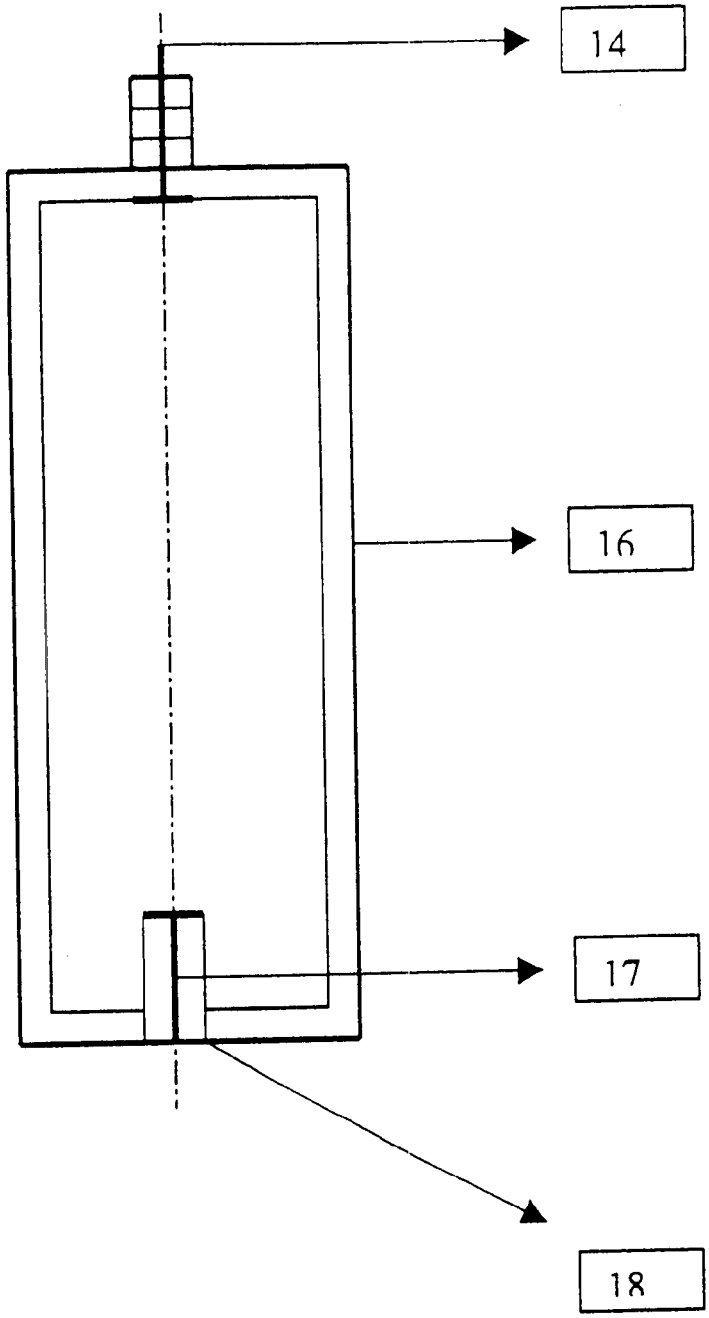
FIG. 2, a schematic cross-sectional view of the compressed-gas magazine to be inserted.

A compressed-gas magazine 16 according to the invention is shown in FIG. 2. This magazine is inserted from below into the pistol grip 30 and has the dimensions as the original magazine (not shown). A laser module 1 with an acceleration switch and batteries (not shown) is inserted into the barrel 9 of the laser pistol of the invention. However, other dispositions of the laser module in front of or next to the spring rod 21 are also conceivable. On the slide 29, in a manner known per se, a rear sight is disposed on the rear end of the slide 29, while for aiming, a front sight known per se for aiming is provided on the front end of the slide 29.

The compressed-gas magazine 16 has a connection valve 14 on its upper end and a connection bore 18 on its lower end, in which bore a check valve 17 is seated. A hose, not shown, can optionally be connected to the check valve 17 and continuously supplies the compressed-gas magazine 16 with compressed air, pressurized nitrogen, or pressurized carbon dioxide. In this last instance, the size of the compressed-gas magazine 16 is naturally no longer a factor.

In the ideal case, the compressed-gas magazine 16 is flush with the lower edge of the pistol grip 30, so that the outer contour of the original Glock® pistol is preserved. A slight enlargement of the compressed-gas magazine 16 and lengthening of the pistol grip 30, however, is also meant to be encompassed by the invention.

In FIG. 3, the construction of the magazine connection piece or adapter 10 is shown; it is connected via its connection 12 to the connection valve 14, and on its upper end it has a hose coupling 11 with an expansion chamber 7 in the slide 29 above the bearing block 8. An opening pin 13 for the connection valve 14 is disposed in the bore 34.

In FIG. 4, the retrofitted barrel 9 with its bearing block 8 is described, which again is adapted in its dimensions to the barrel and bearing block of the particular model of previously known sharpshooting pistol to be retrofitted. Accordingly, it is demonstrated that the replacement system according to the invention comprises practically only the three compact parts to be retrofitted that are shown in FIGS. 2 through 4; as a fourth part, the spring rod 21 and return spring 36 are adapted to the prevailing pressure conditions, in order to press the piston 6 and firing pin piece 5 back via the slide 29. For reducing the recoil, conventional sharpshooting weapons have a barrel lock. The spring force of its restoring spring is about 55 N.

This restoring spring is replaced by a restoring spring 36 of approximately 25 N, in order to make economical use of the existing compressed gas; the barrel lock is advantageously dispensed with and its counterpart on the slide is removed.

Original sharpshooting pistols of any type can in principle therefore be retrofitted simply, quickly, and extremely inexpensively, and reconverted equally simply, quickly and inexpensively.

Figure 5:
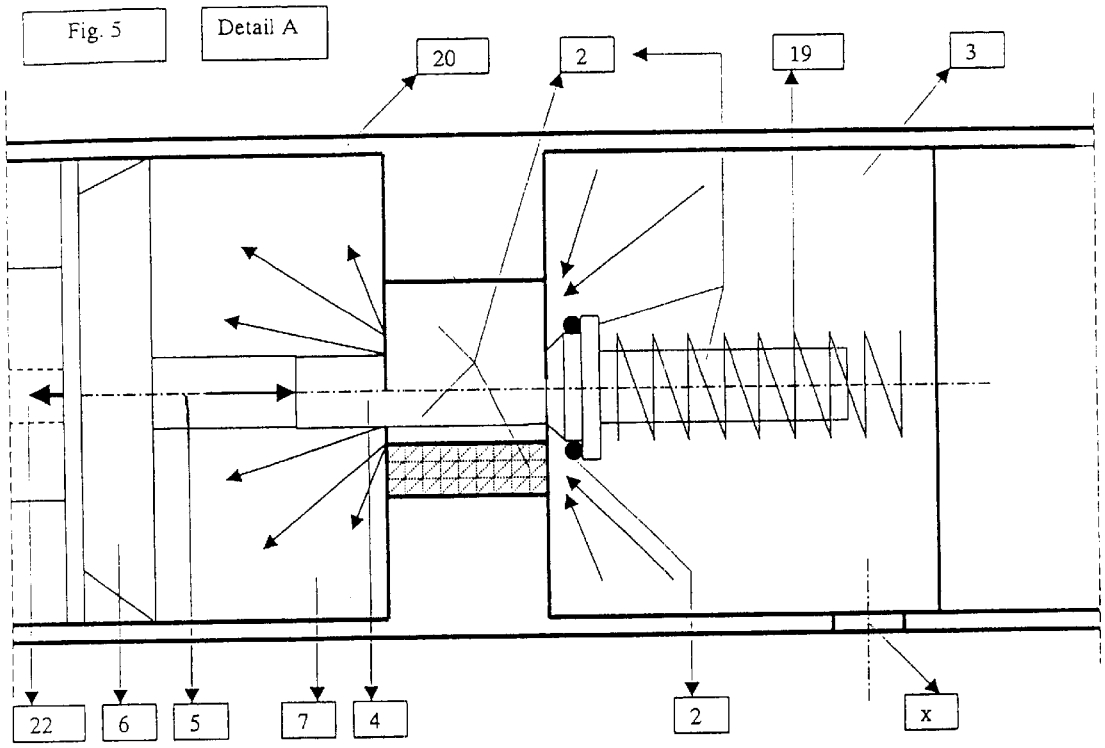
FIG. 5, a fragmentary schematic cross-sectional view of the barrel, showing the details according to the invention in greater detail.

In terms of the method sequence, the compressed-gas magazine 16 is inserted into the pistol grip 30 of the pistol, whereupon the magazine connection valve 14 in the magazine connection piece 10 opens at the opening pin 13. As a result, the compressed gas, in particular compressed air, flows through the magazine connection piece 10 into the bearing block 8, from where it reaches the pressure chamber 3 via the flow opening X downstream of the switchover valve 2. When the striking pin 35 of the laser pistol of the invention makes impact, the firing pin piece 5 is forced against the valve tappet 4, thus opening it against the spring pressure (in this respect see also FIG. 5). As a result, the gas under pressure flows from the pressure chamber 3 through the opened switchover valve 2 into the expansion chamber 7 located in the cylinder housing 20. As a result, the piston 6 is forcefully spun backward together with the firing pin piece 5. During this operation, the expansion chamber 7 is constantly ventilated via the slip or tolerance between the firing pin piece 5 and the piston 6 and through the bore 22 for the firing pin piece 5, and the switchover valve 2 closes by means of pressure of a spring 19. In the present case, a slip or play 15 of about 0.1 mm was selected, but greater or lesser values from one case to another are also conceivable. The high initial pressure still continues to move the piston 6 and slide 29 to the rear. At the terminal point of the piston stroke, the pressure is again adequately relieved by the increase in volume and as a result of the ventilation. As a result, the slide 29, by means of the spring pressure of the return spring 36, presses the piston 6 and the firing pin piece 5 forward. During this operation, ventilation continues to be constant via the firing pin piece 5 and the piston 6, for the sake of achieving a rapid reduction in volume in the expansion chamber 7. As a result, it is attained that the slide 29 snaps forward at a realistic speed. The high speed of this motion is necessary to give the shooter a realistic overall impression of recoil. During the motion of the slide 29, the striking pin 35 and the trigger mechanism of the pistol are tensed. Depending on the pistol model, the hammer (not shown) is also tensed. This is not the case in the Glock® pistol. Simultaneously with the impact of the striking pin 35, a brief laser pulse is tripped with an acceleration switch integrated into the laser module 1. This laser pulse is something that existing interactive shooting systems are capable of evaluating.

What is claimed is:

1. A laser pistol for simulating pistol shots by retrofitting a pistol, comprising:

a pistol grip (30);

a barrel (9) mounted on the pistol grip (30);

a slide (29), which is supported by the pistol grip (30) and is movable along the barrel (9);

a trigger (31) with a trigger guard (32), which are attached to the pistol grip (30) and the barrel (9);

a striking pin mounted in the slide including means for cocking the striking pin (35) and actuating the pistol; and a compressed-gas magazine (16), which is insertable from below into the pistol grip (30) and on its upper end has a connection valve (14) and on its lower end is provided with a connection bore (18), in which a check valve (17) is seated;

a laser module (1) positioned in the barrel (9), which upon actuation of the trigger (31) emits a target-spot laser beam;

an electronic control disposed in the pistol and coupled with the laser (1) and the trigger (31);

a battery in the pistol grip (30) or barrel (9) which is connected to the electronic control;

a compressed-gas cylinder (20) disposed in the slide (29) which is attached to a switchover valve (2) having a valve tappet (4) arranged such that upon actuation of the trigger (31), compressed gas from the compressed-gas cylinder (20), moves a piston (6) rearward via through the switchover valve (2) via the valve tappet (4);

a compressed-gas chamber (3) positioned in the slide such that the compressed-gas cylinder (20) communicates fluidically with the compressed-gas chamber (3) via the switchover valve (2), the compressed-gas magazine (16) is adapted in its dimensions to the magazine of a pistol that is to be retrofitted, and being attached to a magazine connection piece (10), the connection valve (14) being connected to the magazine connection piece (10) which has a through bore (34) having an opening pin (13) for the connection valve (14) and a connection (12) with the compressed-gas magazine (16) and a hose coupling (11) to an expansion chamber (7) in the slide (29) above the a barrel block (8);

and that the piston (6) is positioned in the expansion chamber (7) and is disposed in a bore extending in the longitudinal axis of the barrel (9) and in juxtaposition with a firing pin piece (5) in the bore which is movable in the bore back and forth, which piston is disposed upstream of the tappet (4) of the valve (2), and between the valve (2) and the firing pin piece (5), and the inner wall of the piston is provided with a slight slip or play for ventilating the expansion chamber (7); the striking pin (35) being positioned to impact the firing pin piece (5); and that a spring rod (21) and a return spring (36) are positioned under the barrel and adapted to the existing pressure conditions, in order to press the piston (6) and the firing pin piece (5) back via the slide (29).

2. The laser pistol of claim 1, wherein the compressed gas, comprises compressed air or pressurized nitrogen or carbon dioxide.

3. The laser pistol of claim 1 wherein the switchover valve (2) has a valve tappet (4), which is actuatable by the striking pin (35) coupled with the trigger and that in a first position interrupts the delivery of compressed gas from the compressed-gas magazine (16) to the compressed-gas cylinder (20) and conversely in a second position enables it.

4. The laser pistol of claim 1 comprising a hammer for acting on the striking pin (35) is provided.

5. The laser pistol of claim 1 wherein the magazine connection piece (10) is built solidly into the pistol to be retrofitted but can be detached again for reconversion.

6. The laser pistol of claim 1 wherein the spring force of the return spring is 25 N.

7. The laser pistol of claim 1 wherein the tolerance between the firing pin piece (5) and the inner wall of the piston (6) is approximately 0.1 mm and serves the purpose of ventilation.

8. The laser pistol of claim 1 wherein a hose coupling for the delivery of compressed gas is provided on the check valve (17).

9. A laser pistol for simulating pistol shots by retrofitting a pistol, comprising a pistol grip (30); a barrel (9) mounted on the pistol grip (30); a slide (29), which is supported by the pistol grip (30) and is movable along the barrel (9); a trigger (31) with a trigger guard (32), which are attached to the pistol grip (30) and the barrel (9); a striking pin mounted in the slide including means for cocking the striking pin (35) and actuating the pistol; a hammer for acting on the striking pin (35); a compressed-gas magazine (16), which is insertable from below into the pistol grip (30) and on its upper end has a connection valve (14) and on its lower end is provided with a connection bore (18), in which a check valve (17) is seated; a laser module (1) positioned in the barrel (9), which upon actuation of the trigger (31) emits a target-spot laser beam; an electronic control disposed in the pistol and coupled with the laser (1) and the trigger (31); a battery in the pistol grip (30) or barrel (9) connected to the electronic control; a compressed-gas cylinder (20) in the slide (29) is attached to a switchover valve (2) having a valve tappet (4) arranged such that upon actuation of the trigger (31), compressed gas from the compressed-gas cylinder (20), moves a piston (6) rearward via through the switchover valve (2) via the valve tappet (4); a compressed-gas chamber (3) positioned in the slide such that the compressed-gas cylinder (20) communicates fluidically with the compressed-gas chamber (3) via the switchover valve (2); the compressed-gas magazine (16) is adapted in its dimensions to the magazine of the pistol that is to be retrofitted, and being attached to a magazine connection piece (10), the connection valve (14) being connected to a the magazine connection piece (10) which has a through bore (34) having an opening pin (13) for the connection valve (14) and a connection (12)

with the compressed-gas magazine (16) and a hose coupling (11) to an expansion chamber (7) in the slide (29) above the a barrel block (8); the magazine connection piece (10) being built solidly into the pistol grip, but can be detached again for reconversion; and wherein the striking pin (35) and its location and actuation are maintained; and that the piston (6) is positioned in the expansion chamber (7) and is disposed in a bore extending in the longitudinal axis of the barrel (9) and in juxtaposition with a firing pin piece (5) in the bore which is movable in the bore back and forth, which piston is disposed upstream of the tappet (4) of the valve (2), and between the valve (2) and the firing pin piece (5); and the inner wall of the piston is provided with a slight slip or play for ventilating the expansion chamber (7); the striking pin (35) being positioned to impact the firing pin piece (5); and a spring rod (21) and a return spring (36) are positioned under the barrel and adapted to the existing pressure conditions, in order to press the piston (6) and the firing pin piece (5) back via the slide (29).

10. The laser pistol of claim 1 wherein the spring force of the return spring is 50N.

* * * * *